US011053679B2

(12) United States Patent
Lert, Jr.

(10) Patent No.: US 11,053,679 B2
(45) Date of Patent: Jul. 6, 2021

(54) COLLABORATIVE WORKSTATION SYSTEM WITH INTERCHANGEABLE MOBILE WORKSTATIONS

(71) Applicant: ALERT INNOVATION INC., North Billerica, MA (US)

(72) Inventor: John G. Lert, Jr., Wakefield, MA (US)

(73) Assignee: Alert Innovation Inc., North Billerica, MA (US)

( * ) Notice: Subject to any disclaimer, the term of this patent is extended or adjusted under 35 U.S.C. 154(b) by 0 days.

(21) Appl. No.: 15/885,367

(22) Filed: Jan. 31, 2018

(65) Prior Publication Data

US 2018/0216342 A1 Aug. 2, 2018

Related U.S. Application Data

(60) Provisional application No. 62/452,751, filed on Jan. 31, 2017.

(51) Int. Cl.
*E04B 2/74* (2006.01)
*E04B 1/343* (2006.01)

(52) U.S. Cl.
CPC ..... *E04B 2/7405* (2013.01); *E04B 1/343* (2013.01); *E04B 2/7416* (2013.01); *A47B 2200/0066* (2013.01); *E04B 2002/7483* (2013.01); *E04B 2002/7488* (2013.01)

(58) Field of Classification Search
CPC ..... E04B 2/7405; E04B 2/7416; E04B 2002/7488; A47B 2200/0066
USPC ..... 52/36.1, 238.1–243.1
See application file for complete search history.

(56) References Cited

U.S. PATENT DOCUMENTS 1,428,932 A * 9/1922 Bayer ..... B60B 33/021 16/35 R
4,478,467 A * 10/1984 Tyndall ..... A47B 43/00 211/87.01
4,941,552 A * 7/1990 Screen ..... B60B 33/0042 16/35 R
5,282,341 A * 2/1994 Baloga ..... A47B 83/001 49/41
5,429,432 A * 7/1995 Johnson ..... A63H 3/52 190/11

(Continued)

FOREIGN PATENT DOCUMENTS

EP 0551186 7/1993
JP 2002101959 4/2002

OTHER PUBLICATIONS

International Search Report and Written Opinion dated Apr. 26, 2018 in International Patent Application No. PCT/US2018/016280.

*Primary Examiner* — Brian E Glessner
*Assistant Examiner* — Adam G Barlow
(74) *Attorney, Agent, or Firm* — Vierra Magen Marcus LLP

(57) ABSTRACT

A collaborative mobile workstation system enables users of the workstations to position and reposition their own workstation in a few minutes or less, without requiring substantial disassembly and reassembly. The system enables arrangements that promote collaboration but that can also include open workstations and semi-private workstation formations with four or more substantive walls around a work surface. Each of the mobile workstations within the system is interchangeable with one another.

14 Claims, 4 Drawing Sheets

(56) References Cited

U.S. PATENT DOCUMENTS 6,048,044 A * 4/2000 Biggel ..... A47B 21/00 312/223.3
6,053,588 A * 4/2000 Biggel ..... A47B 21/00 312/249.11
6,170,200 B1 * 1/2001 Cornell ..... E04B 2/827 160/196.1
6,216,398 B1 * 4/2001 Shipman ..... E04B 2/7453 108/50.01
6,374,547 B1 * 4/2002 Baloga ..... G09F 7/08 160/214
6,463,701 B1 * 10/2002 Baloga ..... G09F 7/08 160/214
6,591,563 B2 * 7/2003 King ..... E04B 2/7422 52/220.2
6,684,929 B2 * 2/2004 MacDonald ..... E04B 2/7425 160/135
6,742,307 B2 * 6/2004 Briskman ..... E04B 2/7435 108/60
8,225,724 B2 * 7/2012 O'Brien ..... A47B 43/00 108/115
9,222,255 B2 * 12/2015 Johnson ..... E04F 19/08
9,277,810 B2 * 3/2016 Symonds ..... A47B 21/06
2002/0189180 A1 * 12/2002 King ..... E04B 2/7422 52/243
2003/0182885 A1 * 10/2003 Gresham ..... E04B 2/7425 52/242
2004/0217677 A1 11/2004 Durand et al.
2007/0283630 A1 * 12/2007 Kasdorf ..... E04B 2/7845 52/36.1
2009/0113671 A1 * 5/2009 Chu ..... B60B 33/0073 16/35 R
2009/0145050 A1 * 6/2009 Dugand ..... F16B 12/40 52/36.1
2009/0276977 A1 * 11/2009 Liao ..... B60B 33/021 16/35 R
2012/0186164 A1 * 7/2012 Pensi ..... A47B 96/027 52/36.1
2015/0239291 A1 * 8/2015 Jie ..... B60B 33/0078 16/35 R
2017/0156486 A1 * 6/2017 Blick ..... F16B 12/30

* cited by examiner

COLLABORATIVE WORKSTATION SYSTEM WITH INTERCHANGEABLE MOBILE WORKSTATIONS

PRIORITY CLAIM

The present application claims priority to U.S. Provisional Patent Application No. 62/452,751, filed on Jan. 31, 2017, entitled "COLLABORATIVE WORKSTATION SYSTEM WITH INTERCHANGEABLE MOBILE WORKSTATIONS," which application is incorporated by reference herein in its entirety.

FIELD OF THE INVENTION

The present invention relates to cubicle workstations. In particular, the present invention relates to collaborative mobile workstations that are interchangeable with each other and can be easily repositioned in numerous different configurations, creating both private work areas and spaces for group meetings and collaborations using the same mobile workstation structures.

BACKGROUND

Generally, the cubicle structure is one that is well known in companies. Offices are built out with a plurality of cubicles provided for workers as an alternative to separate brick and mortar offices. Cubicles can be set up in different arrangements, are relatively lower cost, and are easier to dismantle and rebuild than permanent brick and mortar offices.

However, despite the relative lower cost and relative ease of building, dismantling, and rebuilding to suit a particular demand for workstations, the conventional cubicle structure is not one that is easily moved or repositioned without dismantling (fully or partially but substantially) and rebuilding in a manner that can be completed in a manner of minutes versus hours or days.

SUMMARY

There is a need for a workstation system that enables users of the workstations to position and reposition their own cubicle in a few minutes or less, and that enables arrangements that promote collaboration but that can also include semi-private cubicle formations with four or more substantive walls. The present invention is directed toward further solutions to address this need, in addition to having other desirable characteristics.

Specifically, first, second, and third mobile workstations are provided that are each substantially the same configuration, and thereby are interchangeable with each other in terms of position within the system. Each workstation includes casters or other mobility mechanism to enable easy movement of the workstation across a floor for convenient repositioning. As a collaborative workstation system, the configuration of each workstation, first, second, and third mobile workstations are arranged in a generally delta-shaped formation with the first mobile workstation configured as an open workstation area with walls substantially covering only three sides of the first workstation area, the second mobile workstation configured as a semi-private workstation area with walls substantially covering four sides of the second workstation area and a passageway opening at one corner of the second workstation area, and the third mobile workstation configured as an open workstation area with walls substantially covering only three sides of the third workstation area. Other collaborative arrangements are possible by repositioning the mobile workstations relative to each other to create collaborative areas larger than in individual mobile workstation but also bounded by the walls of the mobile workstations.

BRIEF DESCRIPTION OF THE FIGURES

These and other characteristics of the present invention will be more fully understood by reference to the following detailed description in conjunction with the attached drawings, in which.

DETAILED DESCRIPTION

Figure 1:
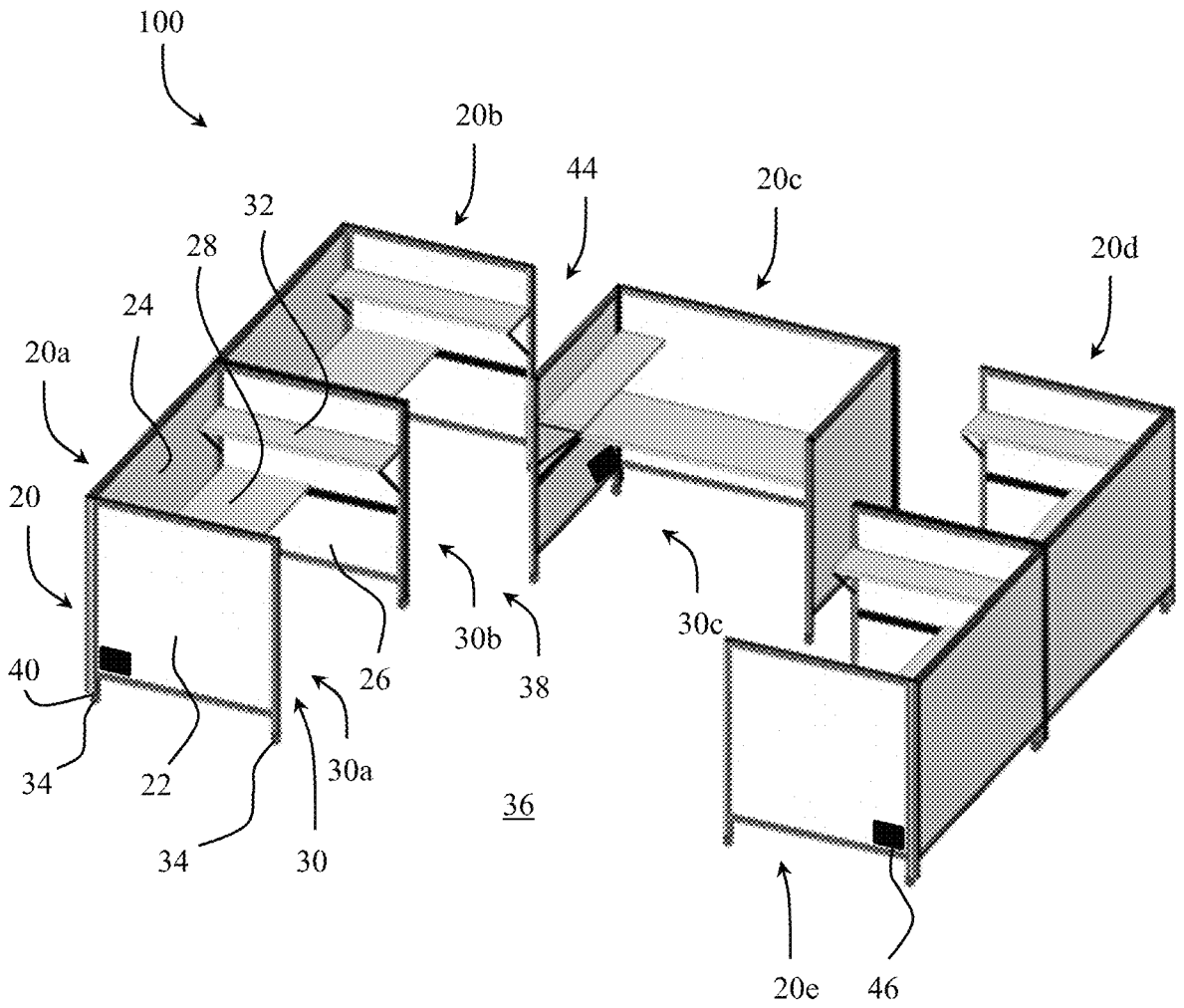
FIG. 1 is an isometric diagrammatic illustration of a system of mobile workstations arranged in a collaborative configuration.

An illustrative embodiment of the present invention relates to a collaborative mobile workstation system that enables users of the workstations to position and reposition their own workstation in a few minutes or less, without requiring substantial disassembly and reassembly, and that enables arrangements that promote collaboration but that can also include open workstations and semi-private workstation formations with four or more substantive walls around a work surface.

FIGS. 1 through 4, wherein like parts are designated by like reference numerals throughout, illustrate an example embodiment or embodiments of a collaborative mobile workstation system, according to the present invention. Although the present invention will be described with reference to the example embodiment or embodiments illustrated in the figures, it should be understood that many alternative forms can embody the present invention. One of skill in the art will additionally appreciate different ways to alter the parameters of the embodiment(s) disclosed, such as the size, shape, or type of elements or materials, in a manner still in keeping with the spirit and scope of the present invention.

A collaborative workstation system 100 has as its fundamental component or building block a mobile workstation 20. As utilized herein, the reference number "20" refers to the mobile workstation, which is interchangeable as a component of the larger collaborative workstation system 100 as further described herein, as well as instances of the mobile workstation, such as mobile workstations 20*a*, 20*b*, 20*c*, 20*d*, 20*e*. The mobile workstation 20 includes a generally vertically oriented wall having a left section 22, a right section 26 opposite the left section 22, and a back section 24 therebetween connecting the left section 22 with the right section 26. The three sections combine to define a perimeter of a workstation area 30. The workstation area 30 is the area occupied by the footprint of the mobile workstation 20, which in the illustrative embodiment is generally a rectangular shaped section defined on three sides by the vertically oriented wall, and on a fourth side going along the opening allowing access into the mobile workstation 20 by a user.

A work surface 28 is coupled to the wall between the right section 26 and the left section 22 in a location that is proximal the back section 24. As would be appreciated by those of skill in the art, the work surface 28 can be coupled or mounted in any conventional manner, such as by a bracket, and can be further supported by one or more legs (not shown) if desired. The brackets can couple the work surface with the left section 22, the back section 24, the right section 26, or any combination thereof.

One or more casters 34 are disposed along a base of the wall supporting the wall and enabling movement of the mobile workstation 20 across a floor surface 36 upon which it rests.

A first mobile workstation 20*a*, a second mobile workstation 20*b*, and a third mobile workstation 20*c* are arranged in a generally delta-shaped formation. The first mobile workstation 20*a* is configured as an open workstation with walls substantially covering only three sides of a first workstation area 30*a*. The second mobile workstation 20*b* is configured as a semi-private workstation with walls substantially covering four sides of a second workstation area 30*b* and a passageway opening 38 at one corner of the second workstation area 30*b*. The third mobile workstation 20*c* is configured as an open workstation with walls substantially covering only three sides of a third workstation area 30*c*.

This structure and arrangement can be expanded upon in numerous different variations, leveraging the mobile workstation 20 as the primary building block. For example, the collaborative workstation system 100 can further include a fourth mobile workstation 20*d* and a fifth mobile workstation 20*e* arranged on an opposite side of the third mobile workstation 20*c* from the first mobile workstation 20*a* and the second mobile workstation 20*b*, as shown in FIG. 1. In this arrangement, the fifth mobile workstation 20*e* mirrors the first mobile workstation 20*a* and the fourth mobile workstation 20*d* mirrors the second mobile workstation 20*b* in arrangement. Likewise in this arrangement, the second mobile workstation 20*b* and the fourth mobile workstation 20*d* are both semi-private workstations, while the first, third, and fifth mobile workstations 20*a*, 20*c*, and 20*e* are all open workstations. Those of skill in the art will appreciated numerous other configurations made possible by the interchangeable mobile workstation 20 of the present invention, such that the present invention is not limited to only the illustrative arrangements depicted herein.

In accordance with aspects of the present invention, the left section 22, the right section 26 opposite the left section 22, and the back section 24, on each of the mobile workstation 20 are oriented at right angles to each other at their line of intersection. This configuration forms a generally U-shape or bracket shape as viewed in planar view from above the mobile workstation 20. The corners of intersection can be actual right angles, or may be curved, for example. The overall shape of the mobile workstation 20 and the workstation area 30 is generally quadrilateral in shape in the illustrative embodiment.

The work surface 28 of the mobile workstation 20 is generally planar in most implementations, but can be modified to suit a particular purpose, as would be appreciated by those of skill in the art. The work surface 28 can be adjustable in height. The work surface 28 is oriented generally horizontally in most implementations, but may also be pitched in a non-horizontal plane, as would be appreciated by those of skill in the art.

The one or more casters 34 of the mobile workstation 20 can be implemented using any known form of caster or other mechanism enabling movement, including but not limited to having a wheel, roller, bearing, rotating sphere, or combinations thereof. The caster, as referred to herein, is defined conventionally but also includes the general concept of enabling gliding, rolling, or otherwise ease of movement, of the mobile workstation 20 across a typical floor 36. The mobile workstation 20 further includes a position locking mechanism 40 configured to hold the mobile workstation 20 in fixed locations. Such locking mechanism 40 can be implemented in numerous different conventional means, including but not limited to a lock on the one or more casters 34, a stop extending against the floor 36, or other conventional locking means as would be appreciated by those of skill in the art.

In certain arrangements, a gap 44 may exist in wall coverage between, e.g., the second mobile workstation 20*b* and the third mobile workstation 20*c* at a corner of the second mobile workstation 20*b* that is adjacent the corner with the passageway opening 38. This gap 44 can form another passageway into the second workstation area 30*b*. Alternatively, the entire arrangement of the first, second, and third mobile workstations 20*a*, 20*b*, 20*c* can be placed against a wall of the room in which they are located to block off that gap 44, as would be readily appreciated by those of skill in the art. Further alternatively, a wall can be extended to cover the gap, or an insert can be provided, such as depicted in FIG. 2 where there is no gap 44.

Figure 2:
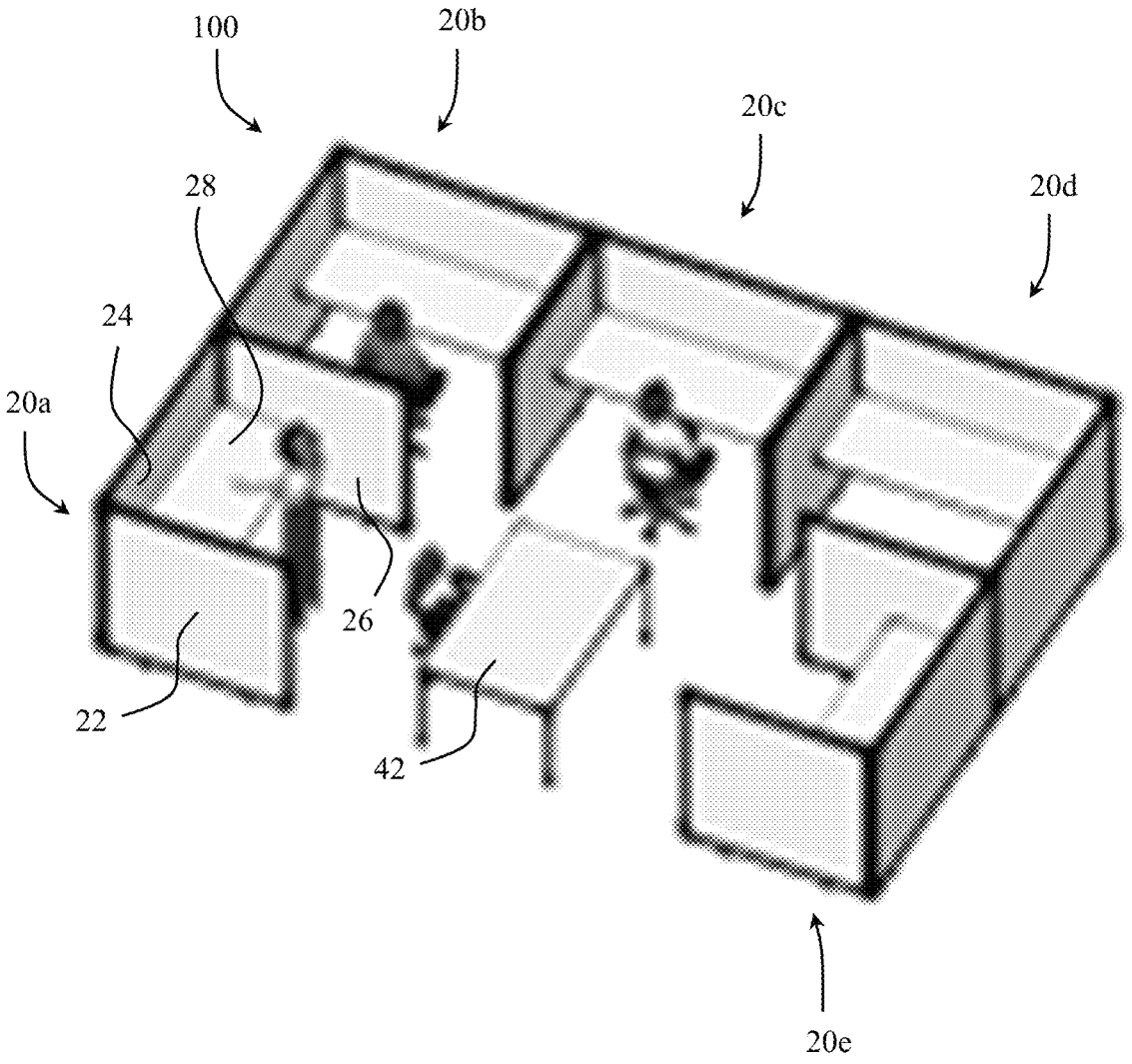
FIG. 2 is an isometric diagrammatic illustration of the system of FIG. 1, arranged in a different collaborative configuration.

FIG. 2 depicts the collaborative workstation system 100 with a central table 42 arranged in an interior work area surrounded by the first mobile workstation 20*a*, second mobile workstation 20*b*, and third mobile workstation 20*c*. Additionally, in the arrangement shown, the fourth mobile workstation 20*d* and fifth mobile workstation 20*e* also surround the central table 42. The central table 42 can include any number of different surfaces or features, such as being a conventional table formed of, e.g., wood, composite, granite, laminate, etc. The central table 42 can alternatively be a whiteboard, have a transparent surface with projection from underneath, be an interactive screen or touchpad, or the like.

The mobile workstation 20 can include any number of different accessories. For example, the mobile workstation 20 can further include a bookshelf 32 mounted on a wall. A serial power strip connection can be provided between the first mobile workstation 20*a* and the second mobile workstation 20*b*. A serial power strip connection can likewise be provided between the second mobile workstation 20*b* and the third mobile workstation 20*c*. Any combination of mobile workstations 20 can include serial power strip connection between adjacent mobile workstations 20. The power strip connection is a conventional electrical connection power coupling as would be readily understood by those of skill in the art, and therefore not shown in the figures. In addition, an connection port 46 can be uniformly located on each of the mobile workstations 20 that includes, e.g., the serial power strip connection as well as other connections such as Ethernet cable jacks or couplings, audio cable jacks or couplings, optical cable jacks or couplings, telephone jacks or couplings, or the like, to enable the mobile workstation 20 to plug into a system of connected mobile workstations 20 and have, e.g., power, data, audio, telephone, and/or other feeds supplied directly to each mobile workstation 20. The user of the mobile workstation 20 can then plug in their own devices to corresponding jacks built into the workstation, or the workstation can have built-in accessories, such as lights, speakers, or phones, that are powered up and communicatively coupled for operation.

The mobile workstations 20 can be constructed of conventional workstation materials, including but not limited to wood, composite, metal, plastic, fabric, and the like.

In operation, a mobile workstation 20 is positioned in a location on a floor 36. If a user desires to move the mobile workstation 20 the locking mechanisms 40 are unlocked and the mobile workstation is pushed, pulled, or otherwise manipulated into a different location on the floor 36, with or without other mobile workstations 20. When the final desired position is achieved, the locking mechanisms 40 are locked. There can be additional brackets, clamps or other mechanisms to bind walls of two adjacent mobile workstations 20 together in a manner that maintains alignment. The additional brackets or clamps can be of numerous configurations as would be appreciated by those of skill in the art.

Figures 3A, 3B, 3C:
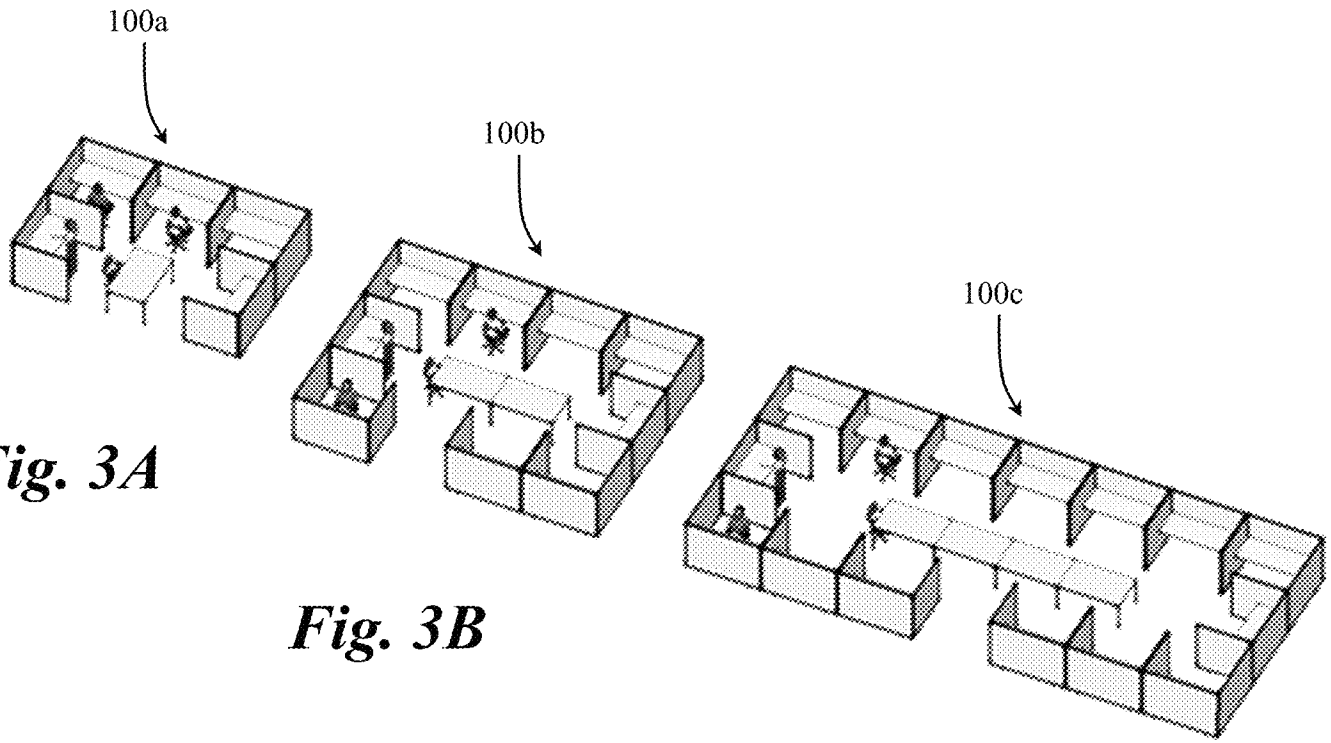
FIG. 3A is an isometric diagrammatic illustration of the system of FIG. 1.
FIG. 3B is an isometric diagrammatic illustration of the system of FIG. 1 with additional mobile workstations added to each side of the configuration.
FIG. 3C is an isometric diagrammatic illustration of the system of FIG. 1 with additional mobile workstations added to each side of the configuration beyond that which is shown in FIG. 3B.

FIGS. 3A, 3B, and 3C depict the collaborative workstation system 100 (100*a*, 100*b*, 100*c*) in a number of different arrangement variations. FIG. 3A shows the collaborative workstation system 100*a* with five mobile workstations 20, two of which are in a semi-private configuration and the remainder are in an open workstation configuration. FIG. 3B shows the collaborative workstation system 100*b* with nine mobile workstations 20, four of which are in a semi-private workstation configuration and the remainder are in an open workstation configuration. FIG. 3C shows the collaborative workstation system 100*c* with fifteen mobile workstations 20, four of which are in a semi-private workstation configuration and the remainder are in an open workstation configuration.

Figure 4:
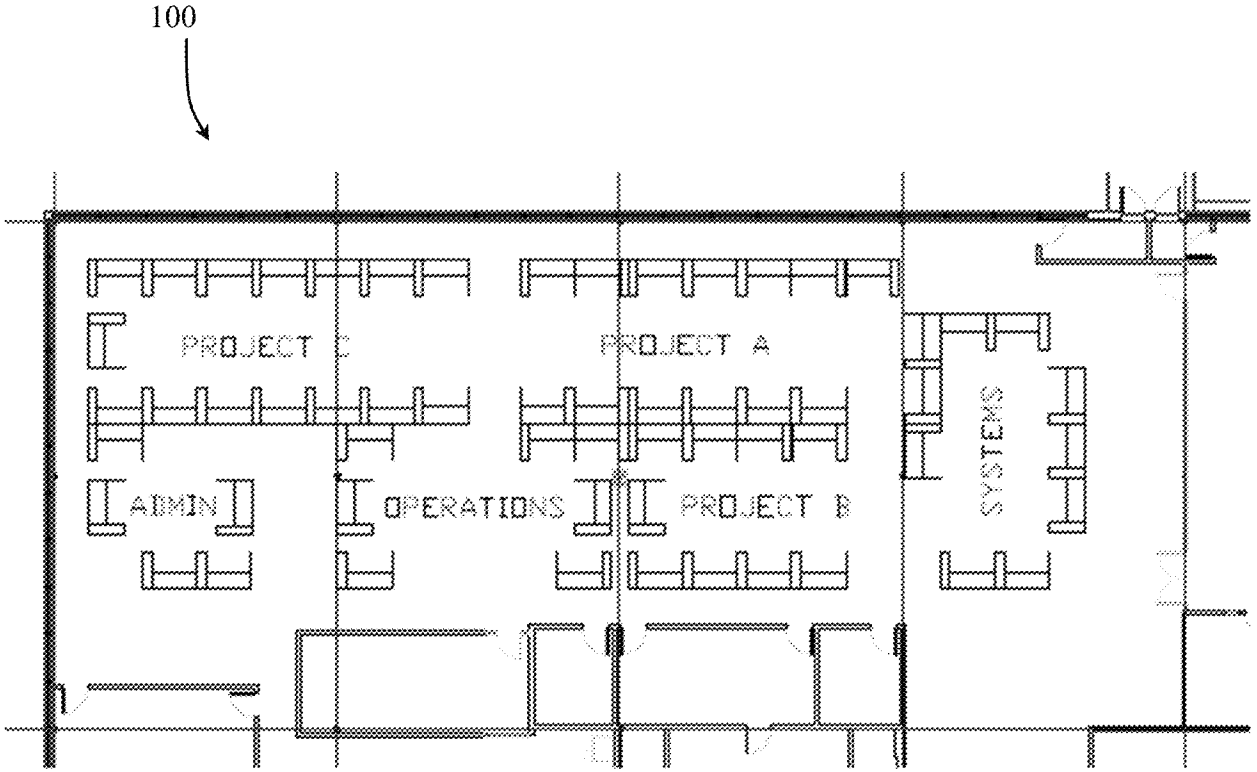
FIG. 4 is a plan view of an office space having a plurality of different configurations of mobile workstations.

FIG. 4 is a plan view of a larger installment of the collaborative workstation system 100. In this figure the versatility and the numerous different example arrangements can be seen.

The collaborative workstation system 100 of the present invention is facilitated by the ease of movement of the mobile workstations without requiring disassembly, and the fact that the mobile workstations 20 are interchangeable with each other. These core features mean that users of the workstations are enabled to easily move the mobile workstations around to form new and different arrangements with collaborative work areas, with our without central tables 42 or other collaborative tools. The mobile workstations 20 can be unlocked, repositioned, and locked in a few minutes or less, without requiring substantial disassembly and reassembly that take hours, such as would be required with prior conventional cubicles, thereby providing a dramatic improvement in workplace environments.

In accordance with example embodiments of the present invention, a collaborative workstation system includes a) a first mobile workstation, including a first wall, generally vertically oriented, and having a left section, a right section opposite the left section, and a back section therebetween connecting the left section with the right section, which defines a first perimeter of a first workstation area; a work surface coupled to the first wall between the right section and the left section and proximal the back section; and one or more casters disposed along a base of the first wall supporting the first wall and enabling movement of the first mobile workstation across a floor surface upon which it rests. The system can further include b) a second mobile workstation, including a second wall, generally vertically oriented, and having a left section, a right section opposite the left section, and a back section therebetween connecting the left section with the right section, which defines a second perimeter of a second workstation area; a work surface coupled to the second wall between the right section and the left section and proximal the back section; and one or more casters disposed along a base of the second wall supporting the second wall and enabling movement of the second mobile workstation across a floor surface upon which it rests. The system can further include c) a third mobile workstation, including a third wall, generally vertically oriented, and having a left section, a right section opposite the left section, and a back section therebetween connecting the left section with the right section, which defines a third perimeter of a third workstation area; a work surface coupled to the third wall between the right section and the left section and proximal the back section; and one or more casters disposed along a base of the third wall supporting the third wall and enabling movement of the third mobile workstation across a floor surface upon which it rests. The first mobile workstation, the second mobile workstation, and the third mobile workstation can be arranged in a generally delta-shaped formation with the first mobile workstation configured as an open workstation with walls substantially covering only three sides of the first workstation area, the second mobile workstation configured as a semi-private workstation with walls substantially covering four sides of the second workstation area and a passageway opening at one corner of the second workstation area, and the third mobile workstation configured as an open workstation with walls substantially covering only three sides of the third workstation area.

The system can further include a fourth mobile workstation and a fifth mobile workstation arranged on an opposite side of the third mobile workstation from the first mobile workstation and the second mobile workstation, in such a way that the fifth mobile workstation mirrors the first mobile workstation and the fourth mobile workstation mirrors the second mobile workstation in arrangement.

In accordance with aspects of the present invention, the left section, the right section opposite the left section, and the back section, on each of the first mobile workstation, second mobile workstation, and third mobile workstation are oriented at right angles to each other at their line of intersection.

In accordance with aspects of the present invention, the work surfaces of each of the first mobile workstation, second mobile workstation, and third mobile workstation can be generally planar. The work surfaces of each of the first mobile workstation, second mobile workstation, and third mobile workstation can be adjustable in height. The work surfaces of each of the first mobile workstation, second mobile workstation, and third mobile workstation can be oriented generally horizontally. The work surfaces of each of the first mobile workstation, second mobile workstation, and third mobile workstation can be pitched in a non-horizontal plane.

In accordance with aspects of the present invention, the one or more casters of each of the first mobile workstation, second mobile workstation, and third mobile workstation can be a wheel, roller, bearing, rotating sphere, or combinations thereof. Each of the first mobile workstation, second mobile workstation, and third mobile workstation further can be a position locking mechanism to hold each of the first, second, and third mobile workstations in fixed locations. Each of the first mobile workstation, second mobile workstation, and third mobile workstation can include workstation areas of a generally quadrilateral shape. One or more central tables can be arranged in an interior work area surrounded by the first mobile workstation, second mobile workstation, and third mobile workstation. A gap in wall coverage can be provided between the second mobile workstation and the third mobile workstation at a corner of the second mobile workstation that is adjacent the corner with the passageway opening.

In accordance with aspects of the present invention, a bookshelf can be mounted on a wall of one or more of the first mobile workstation, the second mobile workstation or the third mobile workstation. A serial power strip connection can be between the first mobile workstation and the second mobile workstation, and between the second mobile workstation and the third mobile workstation.

In accordance with aspects of the present invention, the first mobile workstation, the second mobile workstation, and the third mobile workstation are interchangeable with each other. The first mobile workstation, the second mobile workstation, and the third mobile workstation can be each in a generally U-shaped wall arrangement.

In accordance with aspects of the present invention, a connection port can be disposed on each of the first mobile workstation, the second mobile workstation, and the third mobile workstation which interconnects each workstation. The connection port can include plurality of connections. The connection port can include a plurality of connections selected from the list consisting of power outlets, Ethernet cable jacks or couplings, audio cable jacks or couplings, optical cable jacks or couplings, and telephone jacks or couplings.

In accordance with example embodiments of the present invention, a collaborative workstation system includes a plurality of interchangeable mobile workstations, each workstation having a wall, generally vertically oriented, and having a left section, a right section opposite the left section, and a back section therebetween connecting the left section with the right section, which defines a perimeter of a workstation area. A work surface is coupled to the wall between the right section and the left section and proximal the back section. One or more casters are disposed along a base of the wall supporting the wall and enabling movement of each of the plurality of interchangeable mobile workstations across a floor surface upon which they rest. The plurality of interchangeable mobile workstations are arranged in a generally delta-shaped formation with a first mobile workstation configured as an open workstation with walls substantially covering only three sides of a first workstation area, a second mobile workstation configured as a semi-private workstation with walls substantially covering four sides of a second workstation area and a passageway opening at one corner of the second workstation area, and a third mobile workstation configured as an open workstation with walls substantially covering only three sides of a third workstation area.

In accordance with embodiments of the present invention, a method of using a collaborative workstation system includes, provided a plurality of interchangeable mobile workstations, a user unlocking one or more locking mechanisms to enable one of the plurality of interchangeable mobile workstations to have mobility. The user positions the one of the plurality of mobile workstations in a desired location. The user locks the one of the plurality of mobile workstations in the desired location. The user repeats the process for each of the plurality of interchangeable mobile workstations desired to be repositioned. The method can further include the user connecting one or more connecting ports between two adjacent mobile workstations of the plurality of mobile workstations. The method can further include mechanically coupling two adjacent mobile workstations of the plurality of mobile workstations together.

To any extent utilized herein, the terms "comprises" and "comprising" are intended to be construed as being inclusive, not exclusive. As utilized herein, the terms "exemplary", "example", and "illustrative", are intended to mean "serving as an example, instance, or illustration" and should not be construed as indicating, or not indicating, a preferred or advantageous configuration relative to other configurations. As utilized herein, the terms "about" and "approximately" are intended to cover variations that may existing in the upper and lower limits of the ranges of subjective or objective values, such as variations in properties, parameters, sizes, and dimensions. In one non-limiting example, the terms "about", "approximately", and "generally" mean at, or plus 10 percent or less, or minus 10 percent or less. In one non-limiting example, the terms "about", "approximately", and "generally" mean sufficiently close to be deemed by one of skill in the art in the relevant field to be included. As utilized herein, the terms "substantially" and "generally" refer to the complete or nearly complete extend or degree of an action, characteristic, property, state, structure, item, or result, as would be appreciated by one of skill in the art. For example, an object that is "substantially" circular would mean that the object is either completely a circle to mathematically determinable limits, or nearly a circle as would be recognized or understood by one of skill in the art. The exact allowable degree of deviation from absolute completeness may in some instances depend on the specific context. However, in general, the nearness of completion will be so as to have the same overall result as if absolute and total completion were achieved or obtained. The use of "substantially" is equally applicable when utilized in a negative connotation to refer to the complete or near complete lack of an action, characteristic, property, state, structure, item, or result, as would be appreciated by one of skill in the art.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. Within this specification embodiments have been described in a way which enables a clear and concise specification to be written, but it is intended and will be appreciated that embodiments may be variously combined or separated without parting from the invention. It is intended that the present invention be limited only to the extent required by the appended claims and the applicable rules of law.

It is also to be understood that the following claims are to cover all generic and specific features of the invention described herein, and all statements of the scope of the invention which, as a matter of language, might be said to fall therebetween.

What is claimed is:

1. A collaborative workstation system, comprising:

a plurality of mobile workstations, the plurality of mobile workstations comprising a first group and a second group, each workstation comprising:

a plurality of walls defining three sides of the workstation and an interior work area, the plurality of walls comprising first and second side walls having same dimensions, and a back wall being longer than the side walls and extending between and rigidly affixed to the side walls to form fixed angles with the side walls, a fourth side of the workstation being at least partially open;

a work surface integrated within the interior work area, the first and second side walls each having a length greater than a width of the work surface such that the first and second side walls are configured to block view of the interior work area from a position facing the first or second side walls, exterior to the workstation; and one or more casters disposed along a base of one or more of the plurality of walls, the one or more casters enabling movement of each workstation across a floor surface upon which each workstation rests; wherein the first group is arranged in a first configuration and the second group is arranged in a second configuration wherein, in the first configuration, the plurality of mobile workstations are arranged such that the back walls of each of the plurality of mobile workstations are parallel to each other and aligned with each other, and the first and second sidewalls of at least some of the mobile workstations lie adjacent to each other, the first configuration configured to provide privacy to people sitting at each of the work surfaces in the plurality of workstations by the first and second side walls blocking views of the people from each other; and wherein, in the second configuration different than the first configuration, the plurality of mobile workstations are arranged such that the back walls of a first group of the plurality of mobile workstations are parallel to each other and aligned with each other, and the first and side walls of at least some of the mobile workstations in the first group lie adjacent to each other, and at least one mobile workstation in a second group of mobile workstations, the back wall of the at least one mobile workstation in the second group oriented orthogonally to the back walls in the first group of the plurality of workstations, and the first side wall of a mobile workstation in the second group of mobile workstations aligned in and partially blocking the fourth side of a private workstation in the first group of mobile workstations, the second configuration configured for collaboration by allowing one or more people at the second group of mobile workstations to view one or more people at the first group of mobile workstations through the fourth side of the mobile workstations in the first and second groups, except for the private workstation in the first group of mobile workstations, which private workstation is more closed off and private than other workstations in the first and second groups.

2. The collaborative workstation system of claim 1, wherein the one or more casters are positioned at corners between adjoining walls of the plurality of walls.

3. The collaborative workstation system of claim 1, further comprising a position locking mechanism for securing each workstation in a fixed position.

4. The collaborative workstation system of claim 3, wherein disengagement of the locking mechanism enables movement of each workstation across the floor surface upon which each workstation rests by the one or more casters.

5. The collaborative workstation system of claim 3, wherein the position locking mechanism engages the one or more casters to prevent rolling of the one or more casters.

6. The collaborative workstation system of claim 1, wherein the plurality of mobile workstations are arranged in a formation relative to each other, which structurally defines a plurality of private work areas and a collaborative work area.

7. The collaborative workstation system of claim 1, further comprising a connection port on each workstation.

8. The collaborative workstation system of claim 7, wherein the connection port comprises a power strip configured to receive one or more power cords electrically connecting each workstation and for electrically connecting a power source to each work station.

9. The collaborative workstation system of claim 8, wherein a power cord to a power strip of a work station is configured to be disconnected during movement of the workstation.

10. The collaborative workstation system of claim 7, wherein the connection port comprises a network jack configured to receive one or more network cables connecting each workstation and to connect each workstation to a network.

11. The collaborative workstation system of claim 8, wherein a network cable to a network jack of a work station is configured to be disconnected during movement of the workstation.

12. The collaborative workstation system of claim 7, wherein the connection port comprises a telephone jack configured to receive one or more telephone cables connecting each workstation and to connect each work station to a telephone system.

13. The collaborative workstation system of claim 8, wherein a telephone cable to a telephone jack of a work station is configured to be disconnected during movement of the workstation.

14. The collaborative workstation system of claim 1, wherein the work surface is supported on one or more of the plurality of walls.

* * * * *